US012292245B2

(12) United States Patent
Sharma

(10) Patent No.: US 12,292,245 B2
(45) Date of Patent: May 6, 2025

(54) IMPINGEMENT DEVICE FOR HEAT EXCHANGER INLET TUBE PROTECTION

(71) Applicant: SABIC GLOBAL TECHNOLOGIES B.V., Bergen op Zoom (NL)

(72) Inventor: Ananth Sharma, Bangalore (IN)

(73) Assignee: SABIC Global Technologies B.V., Bergen op Zoom (NL)

( * ) Notice: Subject to any disclaimer, the term of this patent is extended or adjusted under 35 U.S.C. 154(b) by 233 days.

(21) Appl. No.: 17/904,993

(22) PCT Filed: Feb. 25, 2021

(86) PCT No.: PCT/IB2021/051585

§ 371 (c)(1),
(2) Date: Aug. 25, 2022

(87) PCT Pub. No.: WO2021/171223

PCT Pub. Date: Sep. 2, 2021

(65) Prior Publication Data

US 2023/0100209 A1 Mar. 30, 2023

Related U.S. Application Data

(60) Provisional application No. 62/981,981, filed on Feb. 26, 2020.

(51) Int. Cl.
*F28F 19/00* (2006.01)
*F28D 7/16* (2006.01)
(Continued)

(52) U.S. Cl.
CPC ..... *F28F 9/0265* (2013.01); *F28D 7/16* (2013.01); *F28F 9/005* (2013.01); *F28F 9/028* (2013.01); *F28F 19/002* (2013.01); *F28B 9/02* (2013.01)

(58) Field of Classification Search
CPC ..... F28F 19/002; F28F 9/02; F28F 9/0265; F28F 9/028; F28B 9/02; F28D 7/16
See application file for complete search history.

(56) References Cited

U.S. PATENT DOCUMENTS 163,706 A * 5/1875 Wells ..... B01D 45/08 55/444
2,559,069 A * 7/1951 England ..... F28F 19/00 138/42

(Continued)

FOREIGN PATENT DOCUMENTS

CA 1119161 3/1982
CN 208032309 U * 11/2018

(Continued)

OTHER PUBLICATIONS

"Impingement Rods." *Process Engineering*, Sep. 18, 2019, http://www.processengineer.info/heat-exchanger/impingement-rods.html.

(Continued)

*Primary Examiner* — Eric S Ruppert
(74) *Attorney, Agent, or Firm* — Norton Rose Fulbright US LLP

(57) ABSTRACT

Systems, devices, and methods for preventing damage of components of a heat exchanger. In some aspects, a system includes an impingement device for the distribution of fluid flow through an inlet of a heat exchanger that includes a first set of members configured to be disposed between an inlet and one or more process tubes of a heat exchanger and arranged in a first orientation, and a second set of members disposed between the first set of members and the inlet. Each member of the second set of members is arranged in a second orientation that is angularly disposed relative to the first orientation.

17 Claims, 6 Drawing Sheets

(51) Int. Cl.

| | |
|---|---|
| ***F28F 9/00*** | (2006.01) |
| ***F28F 9/02*** | (2006.01) |
| *F28B 9/02* | (2006.01) |

(56) References Cited

U.S. PATENT DOCUMENTS

| | | | | |
|---|---|---|---|---|
| 3,472,315 | A | 10/1969 | Stoker | |
| 4,142,578 | A | 3/1979 | Smith | |
| 4,593,757 | A | 6/1986 | McClintock | |
| 4,665,866 | A | 5/1987 | Wepfer | |
| 4,811,783 | A | 3/1989 | Linzer et al. | |
| 5,150,596 | A | 9/1992 | Hunt et al. | |
| 5,680,775 | A | 10/1997 | Manley | |
| 6,481,208 | B1 * | 11/2002 | Nadig | F01B 31/06 60/687 |
| 2009/0242181 | A1 | 10/2009 | Wanni et al. | |
| 2011/0226455 | A1 | 9/2011 | Al-Anizi et al. | |
| 2015/0083382 | A1 | 3/2015 | Feinstein | |

FOREIGN PATENT DOCUMENTS

| | | | |
|---|---|---|---|
| FR | 984248 | | 7/1951 |
| GB | 2056653 | | 3/1981 |
| JP | 2003240484 A | * | 8/2003 |
| SU | 1180667 A | * | 9/1985 |
| WO | WO 02/090860 | | 11/2002 |
| WO | WO 2009/120385 | | 10/2009 |

OTHER PUBLICATIONS

Al-Anizi et al., "Double Perforated Impingement Plate in Shell-and-Tube Heat Exchanger" *Heat Transfer Engineering* 2009, 30(10-11), 885-894.

Brogan, R.J. *Shell and Tube Heat Exchangers*. Thermopedia, Feb. 2, 2011, http://www.thermopedia.com/content/1121/.

International Search Report and Written Opinion issued in Corresponding PCT Application No. PCT/IB2021/051585, dated May 25, 2021.

Maurya et al., "Numerical Investigation of Isothermal Flow Around Impingement Plates In a Shell and Tube Exchanger" *Journal of Thermal Engineering* 2017, 3(5), 1442-1452.

Shah et al. "Chapter 17: Heat Exchangers." http://www.razifar.com/cariboost_files/Heat_20Exchangers.pdf, 17.1-17.169.

Shilling et al. *STG-19 Design Guidance for Impingement Rods*. HTRI, 2014, https://www.htri.net/stg-19. Accessed Sep. 18, 2019 (Abstract only).

Thulukkanam, Kuppan. "Chapter 5.0: Shell and tube Heat exchanger Design" *Heat Exchanger Handbook—2nd Edition*, CRC Press, 2013, pp. 237-336.

* cited by examiner

IMPINGEMENT DEVICE FOR HEAT EXCHANGER INLET TUBE PROTECTION

CROSS-REFERENCE TO RELATED APPLICATIONS

This application is a national phase under 35 U.S.C. § 371 of International Application No. PCT/IB2021/051585, filed Feb. 25, 2021, which claims the benefit of priority to U.S. Provisional Patent Application Ser. No. 62/981,981, filed Feb. 26, 2020, the entire contents of each of which are hereby incorporated by reference in their entirety.

TECHNICAL FIELD

The present disclosure generally relates to an impingement device, and more specifically, but not by way of limitation, to an impingement device for a heat exchanger.

BACKGROUND

Heat exchanges often use two or more fluids to transfer thermal energy between the fluids for various processes. High flow rates of these fluids can cause corrosion and vibration of components of the heat exchanger, which can deteriorate the components. For example, in a shell and tube type heat exchanger, excessive vibration may damage the shell or tube, and in some instances may cause the tubes to pull out, thereby resulting in cross-contamination of fluids.

Conventionally, an impingement plate may be installed under the inlet nozzle of the shell side of the heat exchanger so that the entering fluid will not impinge the tube bundle. However, use of a plate has multiple drawbacks including decreasing the heat transfer of the system, requiring an increase in the diameter of the shell to fit the plate, formation of dead space directly beneath the plate which allows for accumulation of fouling agents on tubes and decreased heat transfer directly beneath the impingement plate. Additionally, in some instances, if too much of the inlet area is blocked by the plate, production of high localized velocity of the entering fluid accelerating into the gap between the plate and the inlet can cause erosion of the tubes in that area.

SUMMARY

The present disclosure is generally related to systems, devices, and methods for an impingement device for an exchanger, such as a heat exchanger. For example, the impingement device may include first and second sets of members, such as rods or tubes. Each of the first and second sets of members may be configured to be positioned between an inlet and one or more process tubes of the exchanger. Each member of the first set of members may be arranged (e.g., with respect to its longitudinal axis) in a first orientation and each member of the second set of members may be arranged (e.g., with respect to its longitudinal axis) in a second orientation. For example, the first orientation may be substantially orthogonal to the second direction or may be substantially the same as the second direction. Additionally, or alternatively, the first set of members may be positioned between the inlet and the second set of members. The impingement device may be configured to reduce or prevent erosion and/or vibration of process tubes for the exchanger, such as a tube and shell type heat exchanger in high velocity applications.

In some implementations of the present systems, devices, and methods, the impingement device includes or is coupled to a frame. In some implementations, the impingement device also includes a support frame that includes a pair of first support members being substantially parallel to each other, and a pair of second support members positioned orthogonal to the pair of first support members. The pair of second support members may be substantially parallel to each other and/or each of the pair of first support members are vertically displaced from the pair of second support members. In some such implementations, each of the first set of members extends between the pair of support members and/or each of the second set of members extends between the pair of second support members. The support frame may provide stability and ease of assembly and maintenance of the impingement device positioned in a heat exchanger.

Some implementations of the present apparatuses include an apparatus, such as impingement device for use in a shell and tube type heat exchanger. The impingement device includes a first set of members configured to be disposed between an inlet and one or more process tubes of a heat exchanger. Each member of the first set of members is arranged in a first orientation. The impingement device also includes a second set of members disposed between the first set of members and the inlet. Each member of the second set of members is arranged in a second orientation that is angularly disposed relative to the first orientation. In some implementations, each member of the first and second set of members includes a diameter that is less than or equal to a diameter of at least one of the one or more process tubes. Additionally, or alternatively, the diameter of each member of the first and second set of members is approximately between 5 millimeters (mm) and 14 mm. In some implementations, each member of the first and second set of members is solid and/or the first orientation is substantially orthogonal to the second orientation.

In some of the foregoing implementations of the present apparatuses, a center to center distance between adjacent members of the first set of members or the second set of members is approximately between 12-20 mm. Additionally, or alternatively, a length of at least one member of the second set of members is less than a length of a member of the first set of members. The impingement device does not include distributor plates. The impingement device may also include a support frame that includes a pair of first support members (e.g., rods/struts/bars) being substantially parallel to each other, and a pair of second support members (e.g., rods/struts/bars) positioned orthogonal to the pair of first support members. The pair of second support members may be substantially parallel to each other and/or each of the pair of first support members are vertically displaced from the pair of second support members. In some such implementations, each of the first set of members extends between the pair of first support members and/or each of the second set of members extends between the pair of second support members.

Some implementations of the present systems include a heat exchanger, such as a shell and tube type heat exchanger. The heat exchanger includes a vessel body that defines a chamber and an inlet port, one or more process tubes positioned within the chamber, and an impingement device positioned within the chamber between the inlet port and the one or more process tubes. The impingement device includes a plurality of first rods arranged in a first orientation, and a plurality of second rods arranged in a second orientation that is angularly disposed relative to the first orientation. For example, the first orientation may be substantially orthogonal to the second orientation. In some implementations, the impingement device covers an area that is at least 10% greater than an area of the inlet port. Additionally, or alternatively, each rod of the plurality of first and second rods includes a diameter that is less than or equal to a diameter of the one or more process tubes. In some implementations, each rod of the plurality of first and second rods is cylindrical.

In some of the foregoing implementations of the present systems, the impingement device further includes a support frame disposed within the chamber and coupled to the shell (e.g., a housing). The support frame may include a pair of first support members being substantially parallel to each other, and a pair of second support members each positioned orthogonal to the pair of first support members. The pair of second support members may be substantially parallel to each other and/or the pair of first support members may be vertically displaced from the pair of second support members. In some implementations, each of the plurality of first rods extends between the pair of first support members and and/or each of the plurality of second rods extends between the pair of second support members.

In some of the foregoing implementations of the present methods (of assembling an impingement device), the methods include positioning a first set of members at a first orientation within a chamber of a heat exchanger, and positioning a second set of members at a second orientation that is angularly disposed relative to the first orientation. The first orientation may be substantially orthogonal to the second orientation. In some implementations of the present methods, the methods further include positioning the first and second sets of members on a support frame coupled to the heat exchanger between an inlet and a plurality of process tubes.

As used herein, various terminology is used for the purpose of describing particular implementations only and is not intended to be limiting of implementations. For example, as used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed implementations, the term "substantially" may be substituted with "within [a percentage] of" what is specified, where the percentage includes 0.1, 1, 5, and 10 percent.

The term "about" as used herein can allow for a degree of variability in a value or range, for example, within 10%, within 5%, or within 1% of a stated value or of a stated limit of a range and includes the exact stated value or range. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed implementation, the term "substantially" may be substituted with "within [a percentage] of" what is specified, where the percentage includes 0.1, 1, or 5 percent; and the term "approximately" may be substituted with "within 10 percent of" what is specified. The statement "substantially X to Y" has the same meaning as "substantially X to substantially Y," unless indicated otherwise. Likewise, the statement "substantially X, Y, or substantially Z" has the same meaning as "substantially X, substantially Y, or substantially Z," unless indicated otherwise. The phrase "and/or" means and or or. To illustrate, A, B, and/or C includes: A alone, B alone, C alone, a combination of A and B, a combination of A and C, a combination of B and C, or a combination of A, B, and C. In other words, "and/or" operates as an inclusive or. Additionally, the phrase "A, B, C, or a combination thereof" or "A, B, C, or any combination thereof" includes: A alone, B alone, C alone, a combination of A and B, a combination of A and C, a combination of B and C, or a combination of A, B, and C.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those one or more elements. Likewise, a method that "comprises," "has," or "includes" one or more steps possesses those one or more steps, but is not limited to possessing only those one or more steps.

Any implementation of any of the systems, methods, and article of manufacture can consist of or consist essentially of—rather than comprise/have/include—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb. Additionally, the term "wherein" may be used interchangeably with "where". Further, a device or system that is configured in a certain way is configured in at least that way, but it can also be configured in other ways than those specifically described. The feature or features of one implementation may be applied to other implementations, even though not described or illustrated, unless expressly prohibited by this disclosure or the nature of the implementations. The terms "inhibiting" or "reducing" or "preventing" or "avoiding" or any variation of these terms, when used in the claims and/or the specification, include any measurable decrease or complete inhibition to achieve a desired result. The term "effective," as that term is used in the specification and/or claims, means adequate to accomplish a desired, expected, or intended result.

In the context of the present application, at least twenty embodiments are now described. Embodiment 1 is an impingement device for use in a shell and tube type heat exchanger. The impingement device includes a first set of members configured to be disposed between an inlet and one or more process tubes of a heat exchanger, each member of the first set of members arranged in a first orientation; and a second set of members disposed between the first set of members and the inlet, each member of the second set of members arranged in a second orientation that is angularly disposed relative to the first orientation. Embodiment 2 is the impingement device of embodiment 1, wherein each member of the first and second set of members includes a diameter that is less than or equal to a diameter of at least one of the one or more process tubes. Embodiment 3 is the impingement device of embodiment 2, wherein the diameter of each member of the first and second set of members is approximately between 5 millimeters (mm) and 14 mm. Embodiment 4 is the impingement device of embodiment 1, wherein a center to center distance between adjacent members of the first set of members or the second set of members is approximately between 12 millimeters (mm) and 20 mm. Embodiment 5 is the impingement device of embodiments 1 to 4, wherein a length of at least one member of the second set of members is less than a length of a member of the first set of members. Embodiment 6 is the impingement device of embodiment 1, wherein the impingement device does not comprise distributor plates. Embodiment 7 is the impingement device of embodiments 1 to 5, further including a support frame that includes a pair of first support members being substantially parallel to each other; and a pair of second support members positioned orthogonal to the pair of first support members, the pair of second support members being substantially parallel to each other; and wherein each of the pair of first support members are vertically displaced from the pair of second support members. Embodiment 8 is the impingement device of embodiment 7, wherein each of the first set of members extends between the pair of first support members; and each of the second set of members extends between the pair of second support members. Embodiment 9 is the impingement device of embodiments 1 to 5 and 7 to 8, wherein each member of the first and second set of members is solid. Embodiment 10 is the impingement device of any of the preceding embodiments, wherein the first orientation is substantially orthogonal to the second orientation.

Embodiment 11 is a shell and tube type heat exchanger having a vessel body that defines a chamber and an inlet port; one or more process tubes positioned within the chamber; and an impingement device positioned within the chamber between the inlet port and the one or more process tubes. The impingement device includes a plurality of first rods arranged in a first orientation; and a plurality of second rods arranged in a second orientation that is angularly disposed relative to the first orientation. Embodiment 12 is the heat exchanger of embodiment 11, wherein the impingement device further includes a support frame disposed within the chamber and coupled to the shell, the support frame includes: a pair of first support members being substantially parallel to each other; and a pair of second support members each positioned orthogonal to the pair of first support members, the pair of second support members being substantially parallel to each other; and wherein the pair of first support members are vertically displaced from the pair of second support members. Embodiment 13 is the heat exchanger of embodiment 12, wherein each of the plurality of first rods extends between the pair of first support members; and each of the plurality of second rods extends between the pair of second support members. Embodiment 14 is the heat exchanger of embodiment 13, wherein the impingement device covers an area that is at least 10% greater than an area of the inlet port. Embodiment 15 is the heat exchanger of embodiment 11, wherein each rod of the plurality of first and second rods is cylindrical. Embodiment 16 is the heat exchanger of embodiment 15, wherein each rod of the plurality of first and second rods includes a diameter that is less than or equal to a diameter of the one or more process tubes. Embodiment 17 is the heat exchanger of embodiment 11, wherein the first orientation is substantially orthogonal to the second orientation.

Embodiment 18 is a method of assembling an impingement device including the steps of positioning a first set of members at a first orientation within a chamber of a heat exchanger; and positioning a second set of members at a second orientation that is angularly disposed relative to the first orientation. Embodiment 19 is the method of embodiment 18, further including the step of positioning the first and second sets of members on a support frame coupled to the heat exchanger between an inlet and a plurality of process tubes. Embodiment 20 is the method of embodiments 18 or 19, wherein the first orientation is substantially orthogonal to the second orientation.

Some details associated with the implementations are described above, and others are described below. Other implementations, advantages, and features of the present disclosure will become apparent after review of the entire application, including the following sections: Brief Description of the Drawings, Detailed Description, and the Claims.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1A:
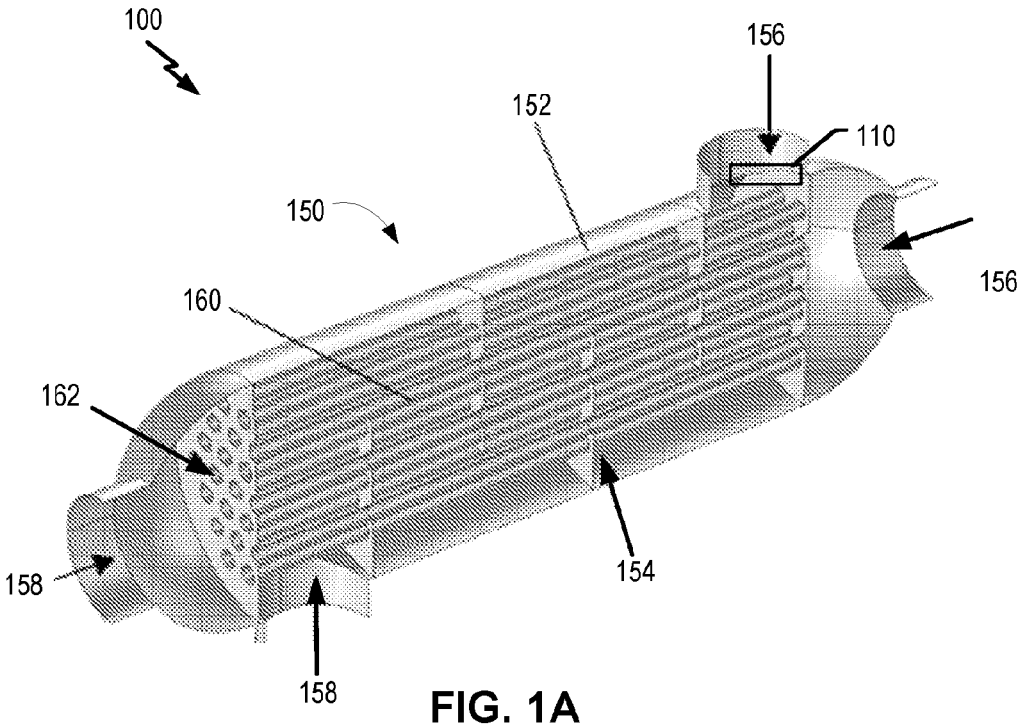
FIG. 1A is an illustrative example of a heat exchange system.
Figure 1B:
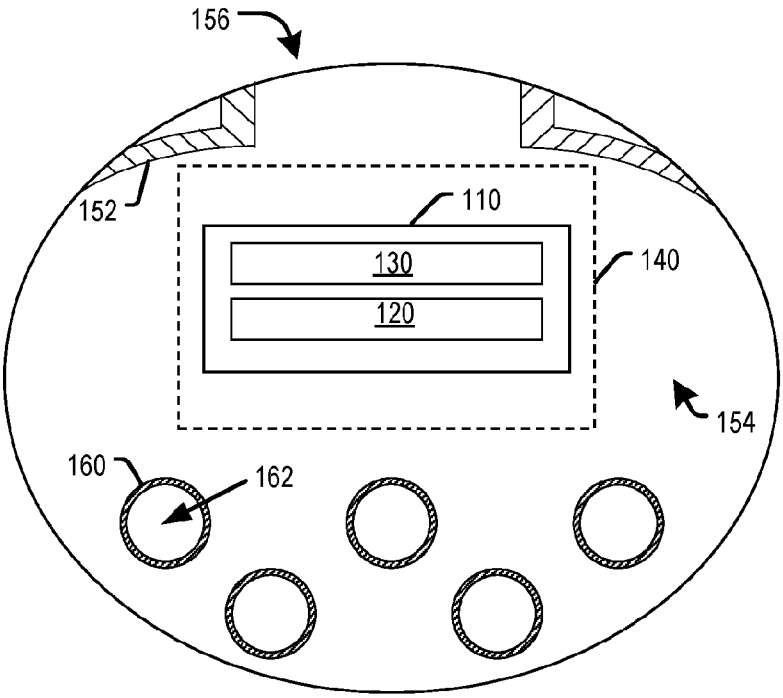
FIG. 1B is an enlarged view of an example of the impingement device used in the heat exchange system of FIG. 1A.

Referring to FIGS. 1A-AB, illustrative views of a heat exchange system 100 are shown. For example, FIG. 1A shows an example of system 100 including a heat exchanger (e.g., 150) and FIG. 1B shows an enlarged view of an impingement device (e.g., 110) used in system 100. System 100 includes a heat exchanger 150 (referred to herein as exchanger 150) and an impingement device 110 (referred to herein as device 110). System 100 may be configured to reduce stresses, erosion, and/or vibrations caused by a fluid, such as a liquid and/or a gas, in high velocity heat exchange applications. As shown, exchanger 150 may include or correspond to a shell and tube heat exchange system, as an illustrative, non-limiting example.

Exchanger 150 may include a shell 152 and a plurality of tubes 160 each configured to convey a separate fluid to initiate transfer of heat between two fluids (e.g., liquids, gases, or mixtures thereof). In such implementations, tubes 160 and at least a portion of shell 152 are not in fluid communication with each other such that a first fluid is transported via tubes 160 and a second fluid is transported within shell 152 do not mix (e.g., cross-contaminate).

Shell 152 defines a chamber 154 having one or more inlets 156 and one or more outlets 158 to enable passage of a fluid through the shell. In some implementations, shell 152 (e.g., vessel body) extends laterally from a first inlet (e.g., 156) to a first outlet (e.g., 158) along a lateral axis to transfer a first fluid from the first inlet to the first outlet of the shell. Inlets 156 and outlets 158 may be positioned in any suitable manner (e.g., on the same or opposing sides of shell 152). Inlets 156 may include or correspond to pipe inlets, vane inlets, splash plate inlets, or the like. In some implementations, each inlet corresponds to a respective outlet and is configured to transport a fluid from the inlet to the outlet. As an illustrative, non-limiting example, shell 152 includes a first inlet (e.g., 156) configured to transport a first liquid through chamber 154 and a second inlet (e.g., 156) configured to transport a second liquid through tubes 160.

Tubes 160 (e.g., processing tubes) may be disposed within chamber 154 and define a conduit 162 configured to transfer a fluid (e.g., second fluid) through the chamber. Tubes 160 may extend along the lateral axis of the shell and may, but need not, extend along an entirety of chamber 154. Tubes 160 may be straight (e.g., single or multi-pass straight-tube heat exchanger), while in other implementations, the tubes may include one or more bends (e.g., U-tube heat exchanger). Additionally, or alternatively, exchanger 150 may include one or more other components, such as, baffles, tube sheets, plenums, midstream components, downstream components, etc.

As shown, device 110 is coupled to exchanger 150 near an inlet (e.g., 156) that is configured to introduce fluid into chamber 154, which may be introduced at a high velocity. For example, device 110 may be in contact with, mounted, and/or secured to exchanger 150 to minimize erosion and vibrations of components (e.g., tubes 160) during operation of the exchanger.

Device 110 includes a set or plurality of first members 120 and a set or plurality of second members 130. As shown in FIG. 1B, device 110 may be disposed within chamber 154 between an inlet (e.g., inlet 156 in communication with chamber 154) and tubes 160. In this way, device 110 may reduce shear stress of a high velocity fluid entering the inlet 156 from acting on tubes 160. In some implementations, first members 120 (e.g., rods) are vertically displaced from second member 130. For example, as shown, second members 130 are positioned between (e.g., interposed) first members 120 and inlet 156 and first members 120 are positioned between second members 130 and tubes 160. In some implementations, each member of the set of first members 120 is arranged in a first orientation and each member of the set of second members 130 is arranged in a second orientation that is angularly disposed relative to the first orientation. In other implementations, the first orientation and the second orientation may be the same such that the first and second members 120, 130 are parallel. As shown, first members and/or second members 120, 130 may have a diameter that is smaller than a diameter of tubes 160. Such implementations may increase flow distribution and/or prevent flow channeling.

In some implementations, device 110 includes a support frame 140 configured to couple first and/or second members 120, 130 to shell 152. Frame 140 may be positioned between inlet 156 and tubes 160 such that first and second members 120, 130 may impede a high velocity fluid entering the inlet. In some implementations, device 110 does not include frame 140 and may be coupled to exchanger 150 through any suitable means known in the art.

In some implementations, device 110 does not include a distributor plate (e.g., distributing vanes). Additionally, or alternatively, device 110 does not include a component with an airfoil cross-section. In an illustrative, non-limiting example, device 110 may consist of first and second members 120, 130.

In some implementations, impingement device 110 may be used in an exchanger, such as a shell and tube type heat exchanger. In some such implementations, device 110 includes first set of members 120 configured to be disposed between inlet 156 and one or more process tubes 160 of exchanger 150. For example, each member of the first set of members 120 may be arranged in a first orientation. In some implementations, device 110 includes a second set of members 130 disposed between the first set of members 120 and the inlet 156. Each member of the second set of members may be arranged in a second orientation that is angularly disposed relative to the first orientation. In some implementations, the first orientation is substantially orthogonal to the second orientation. As such, the first and second set of members may be configured to reduce a velocity of a fluid entering the inlet 156. Each member of the first and second set of members 120, 130 may be solid or hollow. In some implementations, device 110 does not include distributor plates.

Some implementations of system 100 include a shell and tube type heat exchanger (e.g., 150) that includes vessel body (e.g., 152) that defines chamber 154 and the inlet port 156. System 100 may also include one or more process tubes 160 positioned within chamber 154 and device 110 positioned within the chamber between the inlet port 156 and tube(s) 160. In some such implementations, device 110 includes a plurality of first members 120 arranged in a first orientation and a plurality of second members 130 arranged in a second orientation that is angularly disposed relative to the first orientation. In some implementations, support frame 140 is disposed within chamber 154 and coupled to shell 152 of exchanger 150. In some implementations, device 110 covers an area that is at least 10% greater than an area of the inlet port 156. Each rod of the plurality of first and second members 120, 130 may be cylindrical and, in some implementations, each rod of the plurality of first and second members 120, 130 may include a diameter that is less than or equal to a diameter of process tube(s) 160.

Figure 2A:
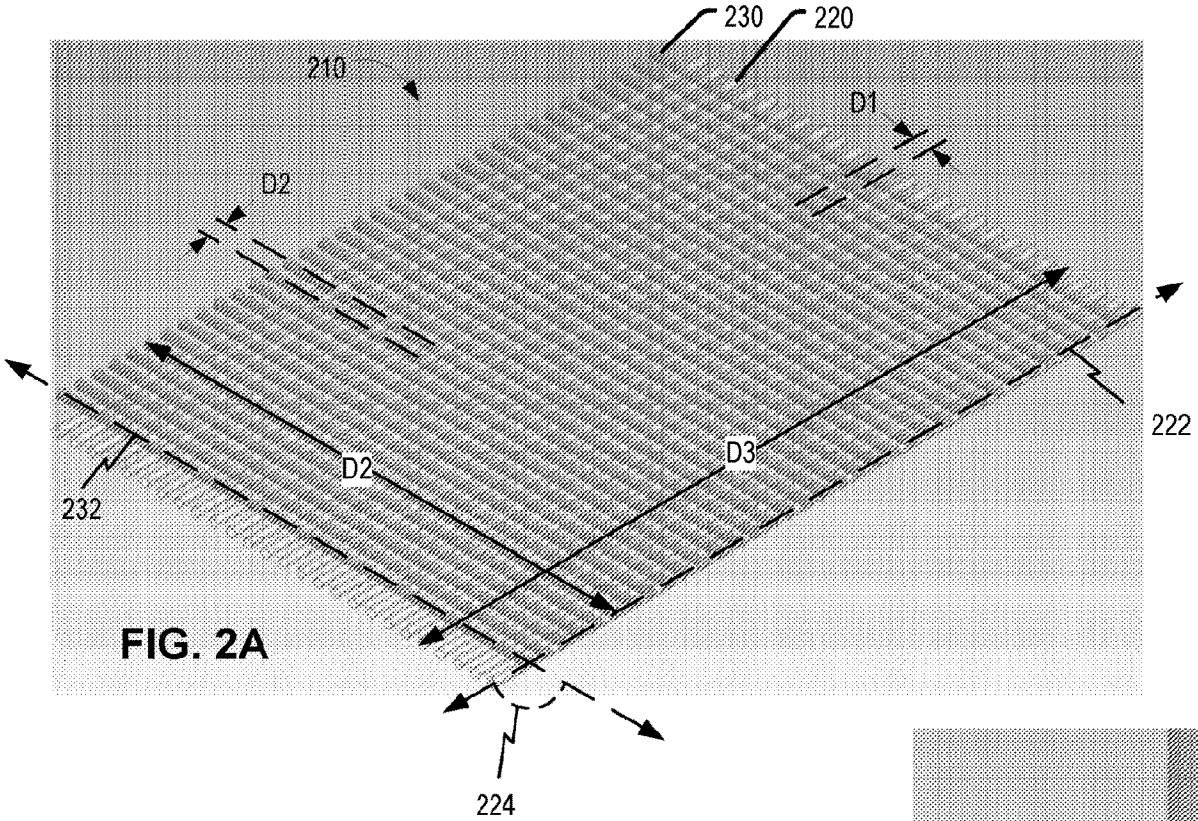
FIG. 2A is an example of an impingement device of a heat exchange system.
Figure 2B:
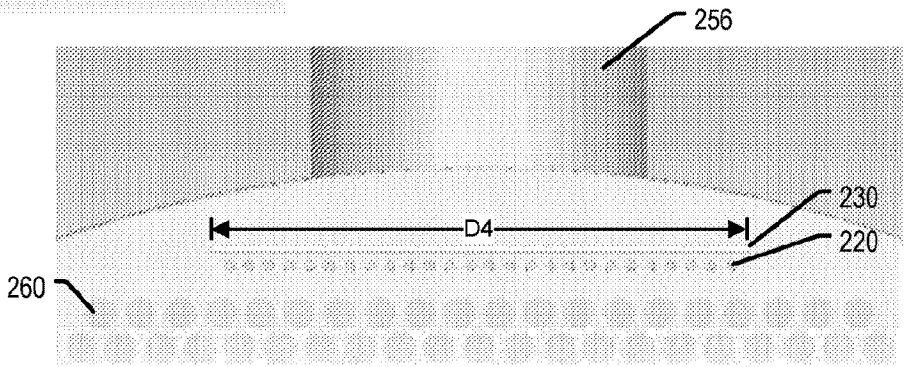
FIG. 2B shows a partial cross-sectional view of the impingement device of FIG. 2A installed within a heat exchanger.

Referring to FIG. 2A-2B, an example of an impingement device 210 of a heat exchange system 200 is shown. For example, FIG. 2A is a perspective view of impingement device 210 and FIG. 2B is a cross sectional view of device 210 positioned within a heat exchanger 250.

Device 210 includes a set or plurality of first members 220 and a set or plurality of second members 230. Device 210 may include or correspond to device 110, and first members 220 and second members 230 may include or correspond to first members 120 and second members 130, respectively. Exchanger 250 may include a shell 252 that defines a chamber 254 and an inlet 256 and a plurality of tubes 260. Shell 252 and tubes 260 may include or correspond to shell 152 and tubes 160, respectively. As shown, device 210 is configured to minimize erosion and vibrations of components (e.g., tubes 260) of exchanger 250 caused by introduction of a fluid via inlet 256.

First members 220 may include a plurality of rods each disposed in a first orientation (e.g., first direction). For example, each first member 220 may extend along a longitudinal axis 222 (e.g., center axis) and are arranged such that the longitudinal axes of each first member are substantially parallel. In some implementations, first members 220 are spaced apart such that a gap is formed between adjacent first members to allow passage of fluid. For example, first members 220 may be spaced apart by a distance D1 (e.g., center-to-center distance) measured between the longitudinal axis 222 of neighboring first members to allow for fluid to pass between the first members 220. Distance D1 of first members 220 may be greater than or equal to any one of, or between any two of: 10, 12, 14, 16, 18, or 20 mm (e.g., such as 16 mm).

Second members 230 may include a plurality of rods each disposed in a second direction. For example, each second member 230 may extend along a longitudinal axis 232 (e.g., center axis) and are arranged such that the longitudinal axes of each second member are substantially parallel. Second members 230 may be spaced apart such that a gap is formed between neighboring second members to allow passage of a fluid. For example, second members 220 may be spaced apart by a distance D2 (e.g., center-to-center distance) measured between the longitudinal axis 232 of adjacent second members to allow for fluid to pass between the second members 230. In some implementations, longitudinal axis 222 of first members 220 and longitudinal axis 232 of second members 230 may be angularly displaced from each other by an angle 224. In some such implementations, angle 224 may greater than or equal to any of, or between any two of, the following: 45, 60, 70, 80, 90, 100, 110, 120, or 135° (e.g., between 80° and 100°, such as approximately 90°). In this way, a velocity of a fluid entering exchanger 250 may be reduced by both first members 220 and second members 230 in a different manner (e.g., flow deflection from first members is in a plane that is angularly disposed relative to flow deflection from the second members). Accordingly, first and second member 220, 230 may be arranged to allow enough fluid to pass through device 210 to prevent increased localized velocity from the fluid flowing through the first and second members and still reduce the overall velocity of the fluid to acceptable levels to reduce erosion and vibration of tubes 260. In other implementations, longitudinal axis 222 of first members 220 and longitudinal axis 232 of second members 230 may be substantially parallel.

Second members 230 can be, but need not be, shaped and sized similarly to (e.g., the same as) first members 220. For example, in some implementations, first members 220 and second members 230 are sized and shaped to fit within a chamber (e.g., 254) of exchanger 250. As shown, first and second members 220, 230 are both cylindrical (e.g., circular cylinder), however, in other implementations first members 220 and/or second members 230 may be shaped to include an elliptical, rounded, rectangular, triangular, polygonal, other suitable cross-section, or a combination thereof. As an illustrative, non-limiting example, first members 220 may alternate between round and elliptical cross-sections, and second members 230 may alternate between round and elliptical cross-sections. In some implementations, first members 220 and second members 230 are not airfoil shaped. Each member of first members 220 and second members 230 includes a maximum transverse dimension (e.g., diameter) measured in a plane orthogonal to the longitudinal axis that may be greater than or equal to any one of, or between any two of: 4, 6, 8, 10, 12, 14, or 16 mm (e.g., such as 8 mm).

In some implementations, each first member 220 includes a length D3 measured along the longitudinal axis. Length D3 of first members 220 may be greater than or equal to any one of, or between any two of: 400, 450, 500, 550, 600, or 650 mm. In some implementations, each second member 230 includes a length D4 measured along the longitudinal axis of the second member. Length D4 of second members 230 may be greater than or equal to any one of, or between any two of: 400, 450, 500, 550, 600, or 650 mm. In some implementations, distance D2 and/or length D4 of second members 230 may be substantially equal to distance D1 and length D3, respectively, of first members 220. In other implementations, distance D2 and/or length D4 of second members 230 may be greater than or less than distance D1 and length D3, respectively, of first members 220. For example, as shown, D4 of second members 230 is greater than D3 of first members 220. In a particular implementation, length D3 of first members 220 is approximately 600 mm (e.g., 594 mm) and length D4 of second members 230 is approximately 450 mm (e.g., 430 mm).

However, first members 220 and second members 230 may be sized and shaped in any suitable manner that would reduce erosion and vibration of one or more components of exchanger 250, as described herein.

In some implementations, first members 220 are vertically displaced from second members 230. For example, first members 220 may lie in a first plane and second members 230 may lie in a second plane that is substantially parallel to the first plane and displaced by a distance. In some implementations, first members 220 may be spaced apart from second members 230 by a distance D5 (e.g., center-to-center distance) measured between a longitudinal axis of a first member and a longitudinal axis of a second member along a straight line (e.g., a line orthogonal to the first and second planes). Distance D5 may be greater than or equal to any one of, or between any two of: 8, 10, 12, 14, 16, 18, or 20 mm (e.g., between 10 and 16 mm, such as 13.85 mm).

As shown in FIG. 2B, device 210 (e.g., first and second members) may be positioned within chamber 254 of shell 252 between inlet 256 and tubes 260. Device 210 may be positioned to cover the inlet 256 to impede a high velocity fluid that is entering chamber 254. For example, lengths D3, D4 of first and second members 220, 230, may be sized such that the device 210 covers an entirety of inlet 256. Specifically, first and second members 220, 230 may be sized such that the impingement device covers an area that is greater than or equal to any one of, or between any two of: 20, 30, 40, 50, 60, 70, 80, 90, 100, 150, 200, 250, or 300% of an area of inlet 256. Such implementations of device 210 may have a higher coverage area (e.g., distribution/dispersion of the fluid) than traditional impingement plates and provide improved flow distribution to tubes 260. Additionally, or alternatively, the transverse dimension (e.g., diameter) of first and second members 220, 230 is less than a maximum transverse diameter (e.g., diameter) of tubes 260. In some implementations, each of first members 220 and second members 230 are solid (e.g., not hollow) to reduce a velocity of a fluid traveling through an inlet of exchanger 250.

Figure 3:
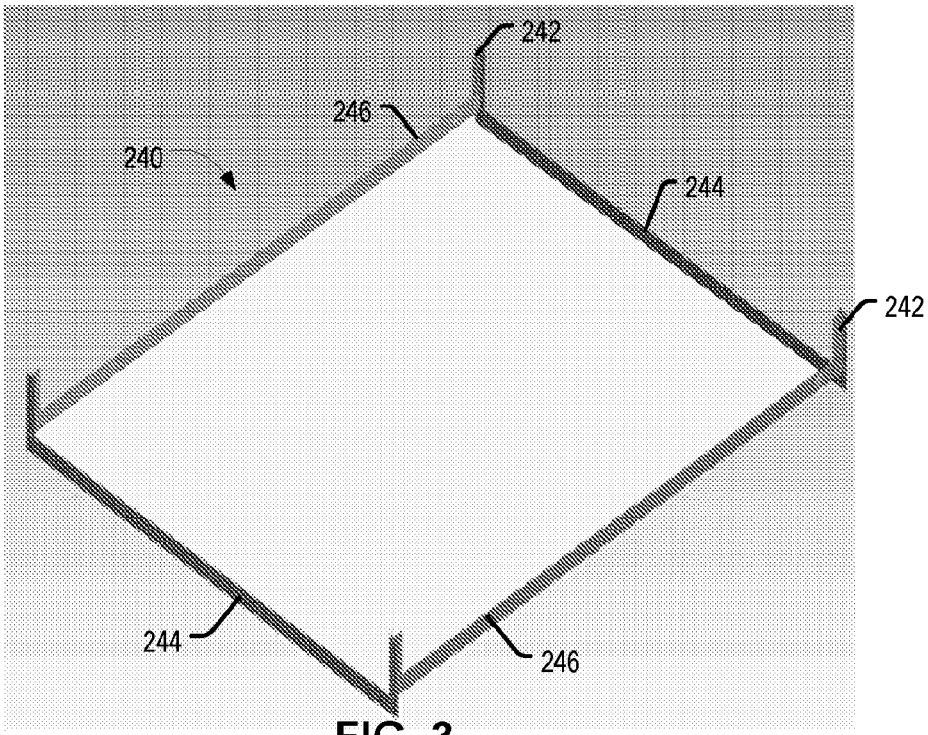
FIG. 3 shows an example of an impingement frame of the heat exchange system.

Referring to FIG. 3, a perspective view of a support frame 240 of system 200 is shown. Frame 240 is configured to secure first members 220 and/or second members 230 within exchanger 250. For example, frame 240 may couple first and second members 220, 230 to shell 252 such that the first and second members are positioned between inlet 256 and tubes 260. As shown, frame 240 may include a plurality of vertical members 242, a pair of first support members 244 (e.g., horizontal bars), and a pair of second support members 246 (e.g., horizontal bars).

In some implementations, first members 244 and second members 146 each include two bars that are substantially parallel to each other. As shown, first and second members 244, 246 may be coupled together to define a rectangular frame (e.g., 240). For example, each first member 244 may extend from one of the second members 246 to the other second members (e.g., 246). In some implementations, first members 244 and/or second members 246 may define apertures to enable first and second members 220, 230 to be coupled to frame 240. First members 244 may be vertically displaced from second members 246 (e.g., by a distance corresponding to distance D5). Additionally, or alternatively, first members 244 may be positioned orthogonal to second members 246. In some implementations, first members 244 may be angularly disposed relative to second members 246 by an angle that corresponds to angle 224. As described above, first members 220 may be spaced apart from second members 230 while the members are coupled to frame 240 allowing for optimized spacing of the members, and thus decreased fluid velocity, based on particular operational parameters of exchanger 250. In some implementations, first and second members 244, 246 may be substantially the same, while in other implementations, first and second members may differ in length to support first and second members 220, 230 as described with reference to FIGS. 4A-4C.

Members 242 may extend vertically upward from first members 244 and/or second members 246. In this way, members 242 may be configured to couple frame 240 to shell 252 of exchanger 250. In some implementations, members 242 may be orthogonal to first members 244 and second members 246. As shown, members 242 may include four bars extending from each intersection of first members 244 and second members 246; however, in other implementations, the vertical bars may be any suitable number of bars.

Figure 4A:
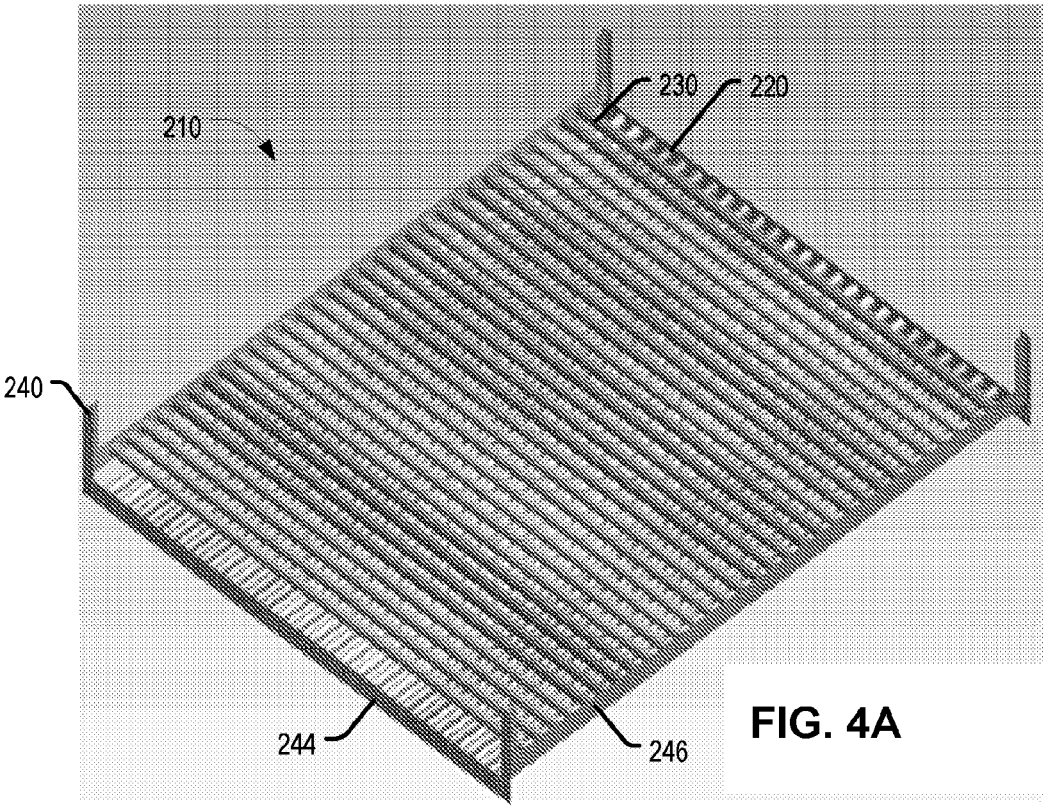
FIG. 4A is another example of an impingement device of the heat exchange system.
Figure 4B:
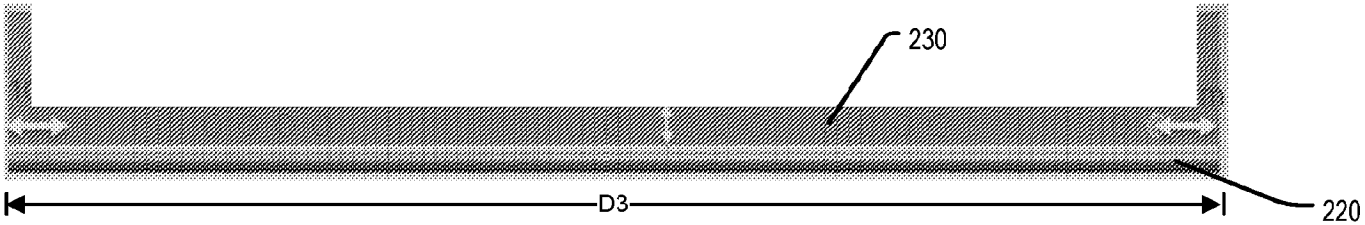
FIGS. 4B and 4C show side views of the impingement device of FIG. 4A.
Figure 4C:
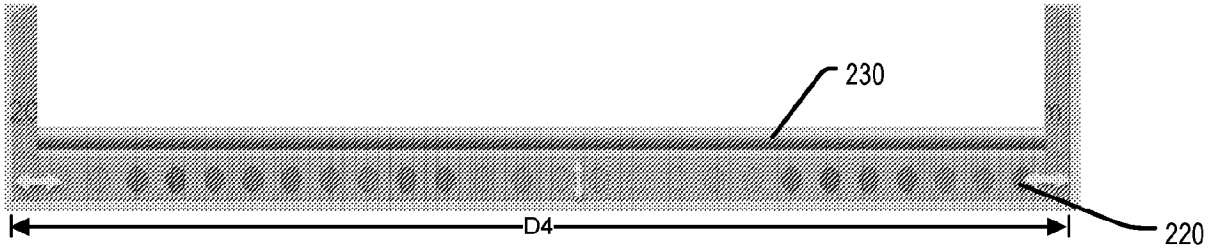
Figure 4D:
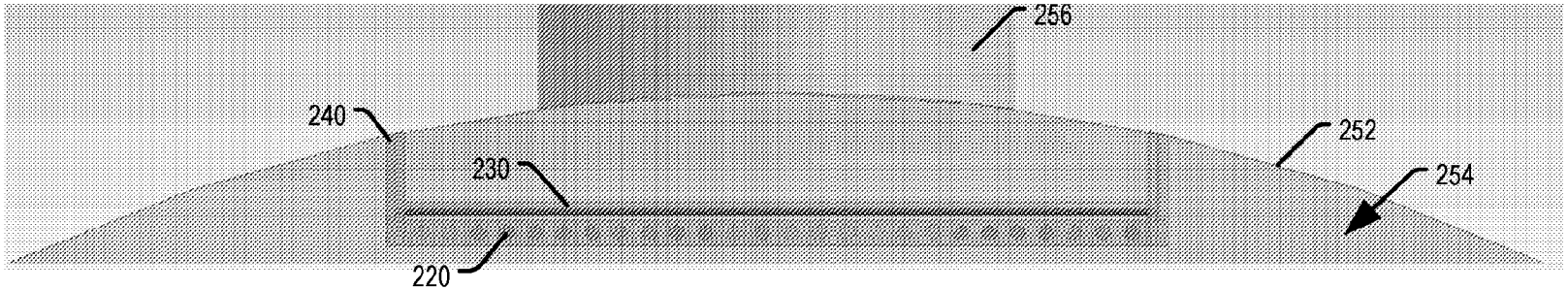
FIG. 4D shows a partial cross-sectional view of the impingement device of FIG. 4A installed within an example of a heat exchanger.

Referring to FIGS. 4A-4C, various views of impingement device 210 coupled to frame 240 are shown. For example, FIG. 4A shows a perspective view of device 210, FIG. 4B shows a side view of device 210 taken normal to second members 246 (e.g., top bars), FIG. 4C shows another side view of device 210 taken normal to first members 244 (e.g., bottom bars), and FIG. 4D shows a cross-sectional side view of device 210 positioned within exchanger 250.

As shown, first and second members 220, 230 are coupled to frame 240. For example, first members 220 may be coupled to first members 244 and second members 230 may be coupled to second members 246. In some implementations, first and second members 220, 230 extend between first and second members 244, 246, respectively. In the depicted implementations, each first member 220 may include a first end that is disposed within an aperture defined by one of the first members 244 and a second end that is disposed within a respective aperture defined by the other first members 244 of the pair of first members (e.g., FIG. 4C). Additionally, or alternatively, each second member 230 may include a first end that is disposed within an aperture defined by one of the second members (e.g., 246) and a second end that is disposed within a respective aperture defined by the other second member (e.g., 246) of the pair of second members (e.g., FIG. 4B). In other implementations, first and second members 220, 230 may be coupled to frame 240 in any suitable manner such as, for example, by an adhesive, weld, fastener, or the like.

As shown, second members 246 may include a length that is greater than first members 244. For example, the length of second members 246 may correspond to D4. Additionally, or alternatively, the length of first members 244 may correspond to D3. In some such implementations, the set of second members 230 may be greater than the set of first members 220. For example, in some implementations, the set of second members 230 may include between 20-30 members (e.g., rods) and the set of first members 220 may include between 15-25 members (e.g., rods). However, the sets of first and second members 220, 230 may include any suitable number of respective members to reduce the velocity of fluid introduced at an inlet (e.g., 256) of heat a exchanger (e.g., 250). Specifically, as shown in FIG. 4D, sets of first and second members 220, 230 may include any suitable number of respective members to cover an area that is greater (e.g., 20-250% greater) than an area of inlet 256. In this way, 210 may be positioned between inlet 256 and process tubes 260 to reduce a velocity of a fluid introduced at the inlet before reaching the tubes. Accordingly, tubes 260 may be subjected to reduced stresses (e.g., shear stress) from the fluid and erosion and vibrations of the tubes can be reduced.

In some implementations, device 210 may be used in a shell and tube type heat exchanger (e.g., 250). Device 210 includes first set of members 220 configured to be disposed between inlet 256 and one or more process tubes 260 of exchanger 250. For example, each member of the first set of members 220 is arranged in a first orientation. In some implementations, device 210 includes a second set of members 230 disposed between the first set of members 220 and the inlet 256, each member of the second set of members arranged in a second orientation that is angularly disposed relative to the first orientation. In some implementations, the first orientation (e.g., 222) is substantially orthogonal to the second orientation (e.g., 224). In some implementations, each member of the first and second set of members 220, 230 includes a diameter that is less than or equal to a diameter of at least one of tubes 260. For example, the diameter of each member of the first and second set of members 220, 230 may be approximately between 5-14 mm, such as 8 mm.

In some implementations, a center to center distance (e.g., D1) between adjacent members of the first set of members 220 is approximately between 12 and 20 mm, such as 16 mm. In some such implementations, a center to center distance (e.g., D2) between adjacent members of the second set of members 230 is approximately between 12 and 20 mm, such as 16 mm. In some implementations, a length (e.g., D4) of at least one member of the second set of members 230 is less than a length (e.g., D3) of a member of the first set of members. Each member of the first and second set of members 220, 230 may be solid. As such, the first and second set of members may be configured to reduce a velocity of a fluid entering the inlet 256. In some implementations, device 210 does not include distributor plates.

Some implementations of device 210 may include a support frame 240 that may be configured to couple the first and second set of members 220, 230 to the heat exchanger 250. In some such implementations, frame 240 includes a pair of first bars (e.g., 244) that are substantially parallel to each other and a pair of second bars (e.g., 246) positioned orthogonal to the pair of first bars, the pair of second bars being substantially parallel to each other. In some implementations, each of the pair of first bars (e.g., 244) are vertically displaced from the pair of second bars (e.g., 246). Additionally, or alternatively, first members 220 may be spaced apart from second members 230 by a distance (e.g., D5) measured between a longitudinal axis (e.g., 222) of a first member and a longitudinal axis (e.g., 232) of a second member along a straight line that may be between 10 and 16 mm, such as 13.85 mm. In some implementations, each of the first set of members 220 extends between the pair of first bars (e.g., 244) and each of the second set of members 230 extends between the pair of second bars (e.g., 246). In some implementations, the first orientation (e.g., 222) is substantially orthogonal to the second orientation (e.g., 232).

Some implementations of system 200 include a shell and tube type heat exchanger (e.g., 250) that includes vessel body (e.g., shell 252) that defines chamber 254 and inlet port 256. System 200 may also include one or more process tubes 260 positioned within chamber 254 and an impingement device 210 positioned within the chamber between the inlet port 256 and the one or more process tubes. In some such implementations, device 210 includes a plurality of first rods (e.g., 220) arranged in a first orientation and a plurality of second rods (e.g., 230) arranged in a second orientation that is angularly disposed relative to the first orientation. In some implementations, system 200 includes a support frame 240 disposed within chamber 254 and coupled to shell 252 of exchanger 250. Frame 240 may include a pair of first bars (e.g., 244) being substantially parallel to each other and a pair of second bars (e.g., 246) each positioned orthogonal to the pair of first bars, the pair of second bars being substantially parallel to each other such that the pair of first bars are vertically displaced from the pair of second bars. In some such implementations, each of the plurality of first rods (e.g., 220) extends between the pair of first bars (e.g., 244) and each of the plurality of second rods (e.g., 230) extends between the pair of second bars (e.g., 246).

In some implementations, device 210 covers an area that is at least 10% greater than an area of inlet port 256. Each rod of the plurality of first and second rods (e.g., 220, 230) may be cylindrical and, in some implementations, each rod of the plurality of first and second rods (e.g., 220, 230) may include a diameter that is less than or equal to a diameter of tube(s) 260.

In some implementations, the method includes assembling an impingement device (e.g., 110, 210). Such methods may be performed at, or with heat exchange system 100, 200 (e.g., one or more components thereof). Some methods include positioning a first set of members at a first orientation within a chamber of a heat exchanger and positioning a second set of members at a second orientation that is angularly disposed relative to the first orientation. Some methods may further include positioning the first and second sets of members on a support frame coupled to the heat exchanger between an inlet and a plurality of process tubes. In some of the present methods, the first orientation is substantially orthogonal to the second orientation.

The systems and processes described herein can also include various equipment that is not shown and is known to one of skill in the art of chemical processing. For example, some controllers, piping, computers, valves, pumps, heaters, thermocouples, pressure indicators, mixers, heat exchangers, and the like may not be shown.

As part of the present disclosure, specific examples are included below. The examples are for illustrative purposes only and are not intended to limit the invention. Those of ordinary skill in the art will readily recognize parameters that can be changed or modified to yield essentially the same results.

Example

Figure 5A:
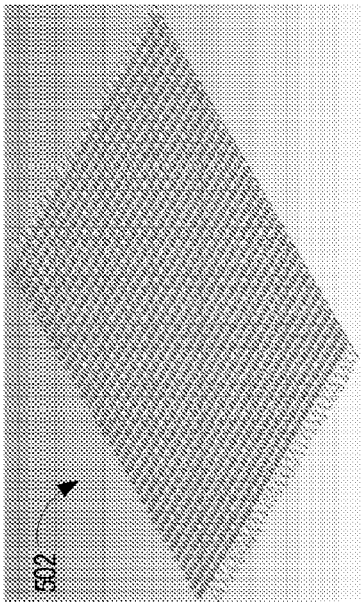
FIGS. 5A, 5B, and 5C each show examples of respective impingement devices of the heat exchange system used in an experimental simulation.
Figure 5B:
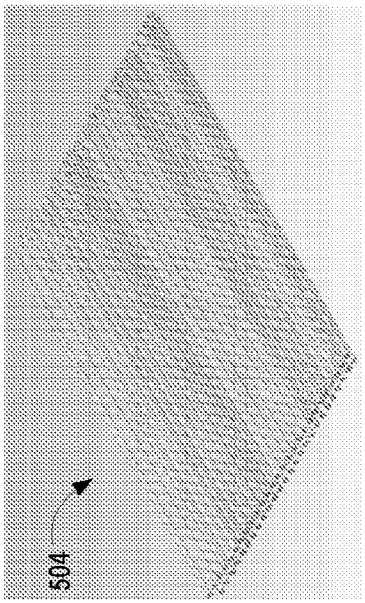
Figure 5C:
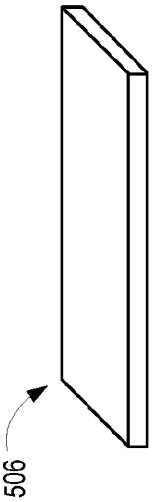

Comparative Analysis of the Present Impingement Device and Other Impingement Devices An Experimental Analysis (e.g., Computational Fluid Dynamics (CFD) Simulation) was performed to compare the performance of the present impingement device(s) (e.g., 110, 210) and other impingement devices. Referring to FIGS. 5A-5C, three examples of impingement devices used in the CFD simulation are shown. For example, FIG. 5A depicts a first example of the present impingement device 502, FIG. 5B depicts a second example of the present impingement device 504, and FIG. 5C depicts an impingement plate 506.

Referring to FIGS. 6A-6C, 7A-7C, 8A-8C, and 9A-9C, the flow profile of a fluid introduced in a heat exchanger that houses a respective impingement device (502, 504, 506) was simulated by modeling the operational conditions of the heat exchanger, as described herein. In the depicted examples, each impingement device was placed within a heat exchanger between an inlet and a plurality of process tubes. A fluid was then introduced at an inlet of the heat exchanger and flow conditions (e.g., velocity and pressure) of the fluid in the heat exchanger were then simulated for each impingement device. For the following simulations, fluid was introduced into the heat exchanger at 28 m/s, the area of the inlet was 0.0568 $m^2$ and the area of the impingement device was 0.1143 $m^2$ for each device (e.g., area of impingement device greater than 100% of the area of inlet), the devices were placed 960 mm above a center axis of the shell, and the fluid had a density of 5.63 kg/s, a viscosity of 1.517E-5 kg/m-s with an inlet mass flow of 9.7 kg/s. All plots have same scale for comparison and each component (e.g., heat exchanger, process tubes, etc.) was equally sized and positioned for accurate comparative results.

Figure 6D:
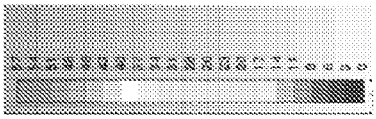
FIG. 6D is a legend that corresponds to a velocity of the models of FIGS. 6A-6C.
Figure 6A:
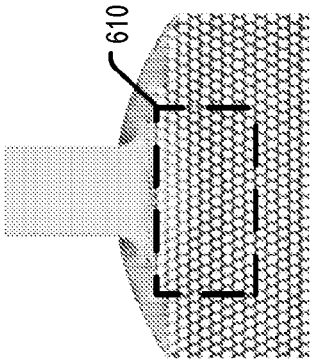
FIGS. 6A, 6B, and 6C are each a first illustrative model of a velocity profile of the experimental simulation for the impingement devices of FIGS. 5A-5C, respectively.
Figure 6B:
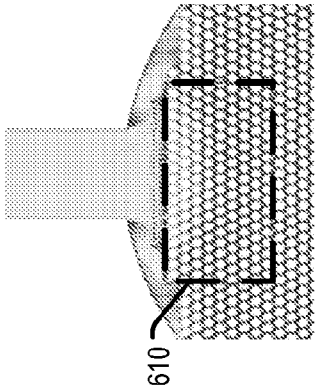
Figure 6C:
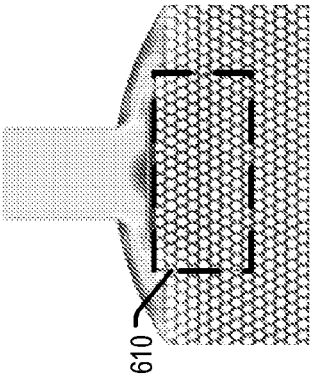

Referring to FIGS. 6A-6D, an illustrative model of the CFD analysis showing a velocity profile of a fluid entering a heat exchanger 550 (e.g., shell) along a first plane that is orthogonal to process tubes 560 is shown. FIGS. 6A, 6B, and 6C depict the velocity profiles for impingement device 502 (e.g., crossed impingement device), impingement device 504 (parallel impingement device), and impingement plate 506, respectively. FIG. 6D is a legend that shows the velocity of the fluid (in meters/second) for each simulation. As shown in FIGS. 6A, 6B and 6C, a maximum stress area 610 where fluid acts on a top layer of process tubes 560 is shown. Table 1, reproduced below, illustrates a pressure drop and a maximum velocity of the fluid within the maximum stress area 610.

TABLE 1

| Case | Description | Max velocity [m/s] | Pressure drop (Pa) | Max Wall shear stress on process tubes (Pa) |
|---|---|---|---|---|
| Impingement device 502 | A set of first members arranged in a first orientation; and a set of second members arranged in a second orientation that is angularly disposed relative to the first orientation by 90 degrees | 48 | 6862 | 37 |
| Impingement device 504 | A set of first members and a set of second members arranged parallel to each other | 48 | 6996 | 37.5 |
| Impingement plate 506 | Solid rectangular plate | 58 | 8486 | 54.5 |

As shown in Table 1, pressure drop was modeled for only a portion of the heat exchanger and the pressure drop shown is only a fraction of the total pressure drop. Accordingly, values of pressure drop, velocity, and shear stress should be used on a relative basis, as a comparison between the three devices, rather than an indicator of the flow characteristics of the heat exchanger as a whole. As shown, impingement device 502 and impingement device 504 have a decreased maximum fluid velocity as compared to impingement plate 506. Accordingly, impingement device 502 and impingement device 504 decreased the wall shear stress on process tubes 560 during operation of heat exchanger 550. The wall shear stress was defined as the tangential stress on process tube walls due to impinging of the fluid onto process tubes 560. Both impingement devices 502, 504 showed good flow distribution across the process tube bank. For example, high velocity regions seen in impingement plate 506 case can be eliminated or minimized and velocity in the region was uniform so that the fluid maintained an average uniform velocity.

Figure 7A:
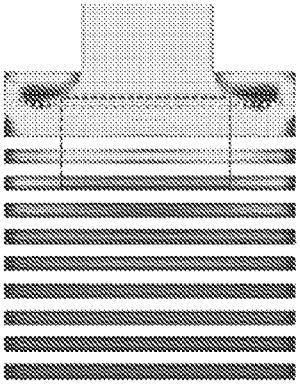
FIGS. 7A, 7B, and 7C are each a second illustrative model of the velocity profiles of the experimental simulation for the impingement devices of FIGS. 5A-5C, respectively.
Figure 7B:
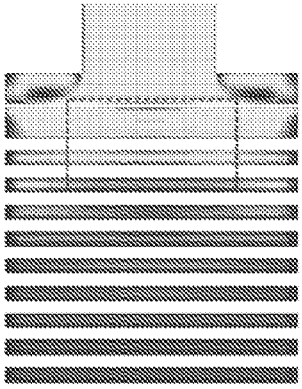
Figure 7C:
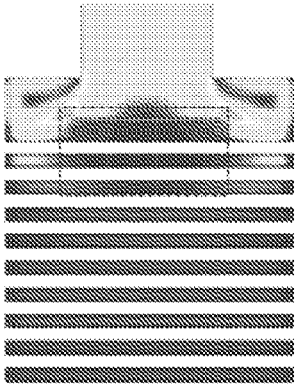

Referring now to FIGS. 7A-7C, a velocity profile of the fluid along a second plane that is parallel to a central axis (e.g., longitudinal axis) of process tubes 560 is shown. FIGS. 7A, 7B, and 7C depict the velocity profiles for impingement device 502 (e.g., crossed impingement device), impingement device 504 (parallel impingement device), and impingement plate 506, respectively. The velocity profile depicted in FIGS. 7A-7C corresponds to the legend shown in FIG. 6D. As shown, impingement plate 506 created a large dead zone immediately behind the plate at the top row of process tubes 560. While the dead zone decreased the velocity of fluid acting on the top row of tubes 560, it is not desirable and can cause accumulation of fouling agents on top row of tubes that contribute to erosion, effectively lowering the efficiency of the heat exchanger. As shown, the impingement devices 502, 504 reduced low velocity regions (e.g., dead zones) below the impingement device.

Impingement devices 502, 504 showed similar flow characteristics of the fluid entering heat exchanger. However, impingement device 502 (e.g., crossed impingement device) performed better than impingement device 504 (e.g., parallel impingement device). For example, while the maximum velocity of the crossed impingement device 502 was slightly higher, the pressure drop across the crossed impingement device was lower leading to a more uniform flow. This can be seen in FIG. 6A, as the re-circulation zone of impingement device 504 (e.g., parallel impingement device) between the ends of the impingement device 504 and the shell was greater than that shown for impingement device 502 (e.g., crossed impingement device). The increased re-circulation zone may lead to decreased heat transfer and potentially, unbalanced forces that result in vibration of the process tubes 560.

Figure 8A:
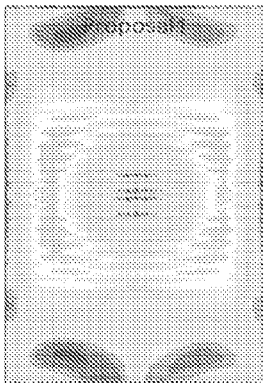
FIGS. 8A, 8B, and 8C are each a third illustrative model of the velocity profile of the experimental simulation for the impingement devices of FIGS. 5A-5C, respectively.
Figure 8B:
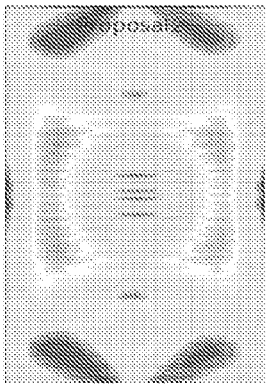
Figure 8C:
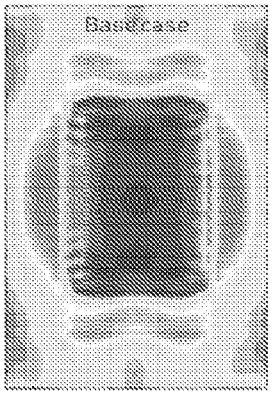
Figure 8D:
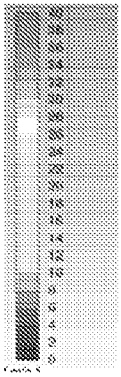
FIG. 8D is a legend that corresponds to a velocity of the models of FIGS. 8A-8C.

Referring now to FIGS. 8A-8C, plan views of the CFD simulation are shown. For example, FIGS. 8A-8C show a velocity profile of the fluid along a third plane that is interposed between the impingement devices and the top row of process tubes for impingement device 502 (e.g., crossed impingement device), impingement device 504 (parallel impingement device), and impingement plate 506, respectively. FIG. 8D is a legend that shows the velocity of the fluid (in meters/second) for each simulation. As shown in FIG. 8C, impingement plate 506 created a large dead zone immediately below the plate and had increased velocity of the fluid that is diverted around the edges of the plate. FIGS. 8A and 8B illustrate decreased dead zones with lower fluid velocities. For example, as shown in FIG. 8B, impingement device 504 (parallel impingement device) provided more uniform velocity of the fluid; however, small dead zones appeared just at the top and bottom edge of the impingement device (e.g., 504). This enables the formation of a larger re-circulation zone with higher fluid velocities. Impingement device 502 (e.g., crossed impingement device) provided better flow distribution (e.g., more uniform velocity) just before the process tube banks than either impingement device 504 or impingement plate 506. As shown in FIG. 8A, impingement device 502 created a uniform velocity of the fluid with only slight re-circulation at the top and bottom near the walls (e.g., shell) of the heat exchanger. This symbolizes a better flow distribution with decreased chance of vibration in the process tubes (e.g., 560).

Figure 9A:
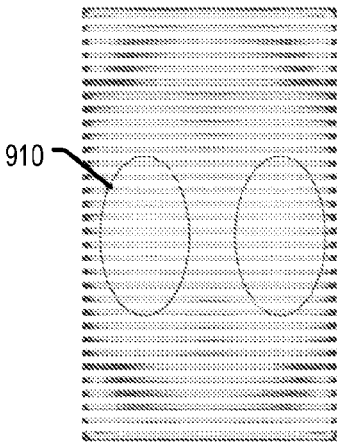
FIGS. 9A, 9B, and 9C are each a fourth illustrative model of the velocity profile of the experimental simulation for the impingement devices of FIGS. 5A-5C, respectively.
Figure 9B:
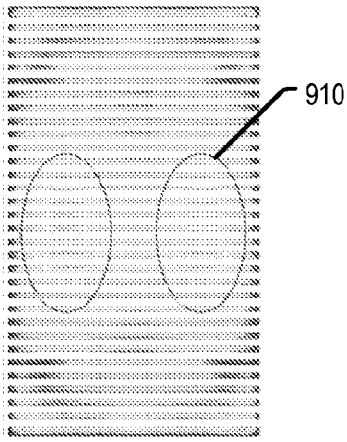
Figure 9C:
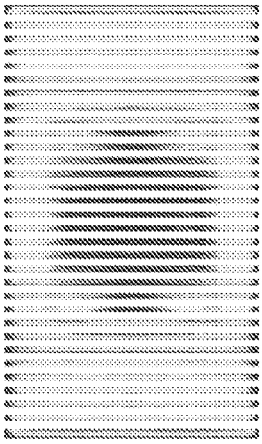

Referring to FIGS. 9A-9C, a velocity profile of the fluid along a fourth plane that is immediately below the top row of process tubes is shown. FIGS. 9A, 9B, and 9C depict the velocity profiles for impingement device 502 (e.g., crossed impingement device), impingement device 504 (parallel impingement device), and impingement plate 506, respectively. The velocity profile depicted in FIGS. 9A-9C corresponds to the legend shown in FIG. 8D. As shown in FIGS. 9A and 9B, a maximum stress area 910 where the fluid acts on the top layer of process tubes 560 is shown.

As shown, while uniform velocity distribution in the process tube bank was observed for both impingement device (502, 504) as compared to impingement plate 506, the impingement device 502 (e.g., crossed impingement device) provided better flow distribution just after the top row of process tubes (e.g., 560). Similar to FIGS. 8A and 8B, the re-circulation zones for impingement device 502 was smaller than the re-circulation zones of impingement device 504 directly after interaction with the process tubes as shown in FIGS. 9A and 9B. As shown, the peak velocities of the fluid between process tubes in maximum stress areas 910 was also less for impingement device 502 (e.g., crossed impingement device) as compared to impingement device 504 (parallel impingement device). Consequently, impingement device 502 (e.g., crossed impingement device) demonstrated an improvement to prevent erosion and vibration of process tubes for a tube and shell type heat exchanger in high velocity applications.

Although aspects of the present application and their advantages have been described in detail, it should be understood that various changes, substitutions and alterations can be made herein without departing from the spirit and scope of the disclosure as defined by the appended claims. Moreover, the scope of the present application is not intended to be limited to the particular implementations of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding implementations described herein may be utilized. Accordingly, the appended claims are intended to include within their scope such processes, machines, manufacture, compositions of matter, means, methods, or steps.

The above specification provides a complete description of the structure and use of illustrative configurations. Although certain configurations have been described above with a certain degree of particularity, or with reference to one or more individual configurations, those skilled in the art could make numerous alterations to the disclosed configurations without departing from the scope of this disclosure. As such, the various illustrative configurations of the methods and systems are not intended to be limited to the particular forms disclosed. Rather, they include all modifications and alternatives falling within the scope of the claims, and configurations other than the one shown may include some or all of the features of the depicted configurations. For example, elements may be omitted or combined as a unitary structure, connections may be substituted, or both. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one configuration or may relate to several configurations. Accordingly, no single implementation described herein should be construed as limiting and implementations of the disclosure may be suitably combined without departing from the teachings of the disclosure.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims. The claims are not intended to include, and should not be interpreted to include, means-plus- or step-plus-function limitations, unless such a limitation is explicitly recited in a given claim using the phrase(s) "means for" or "step for," respectively.

What is claimed is:

1. An impingement device for use in a shell and tube type heat exchanger, the impingement device comprising:

a first set of members disposed between an inlet and one or more process tubes of a heat exchanger, each member of the first set of members arranged in a first orientation; and a second set of members disposed between the first set of members and the inlet, each member of the second set of members arranged in a second orientation that is angularly disposed relative to the first orientation, wherein each member of the first and second set of members is solid, wherein the first set of members is vertically displaced from the second set of members and the first set of members does not contact the second set of members, wherein the diameter of each member of the first and second set of members is approximately between 5 millimeters (mm) and 14 mm, and wherein a center to center distance between adjacent members of the first set of members or the second set of members is approximately between 12 mm and 20 mm;

a support frame that includes:

a pair of first support members being substantially parallel to each other; and a pair of second support members positioned orthogonal to the pair of first support members, the pair of second support members being substantially parallel to each other; and wherein each of the pair of first support members are vertically displaced from the pair of second support members.

2. The impingement device of claim 1, wherein each member of the first and second set of members includes a diameter that is less than or equal to a diameter of at least one of the one or more process tubes.

3. The impingement device of claim 2, wherein the impingement device does not comprise distributor plates.

4. The impingement device of claim 1, wherein a length of at least one member of the second set of members is less than a length of a member of the first set of members.

5. The impingement device of claim 1, wherein the impingement device does not comprise distributor plates.

6. The impingement device of claim 1, wherein: each of the first set of members extends between the pair of first support members; and each of the second set of members extends between the pair of second support members.

7. The impingement device of claim 1, wherein the first orientation is substantially orthogonal to the second orientation.

8. A shell and tube type heat exchanger comprising:

a vessel body that defines a chamber and an inlet port; one or more process tubes positioned within the chamber; and an impingement device according to claim 1 positioned within the chamber between the inlet port and the one or more process tubes, the impingement device comprising:

a plurality of first rods arranged in a first orientation; and a plurality of second rods arranged in a second orientation that is angularly disposed relative to the first orientation.

9. The heat exchanger of claim 8, wherein the impingement device further comprises:

a support frame disposed within the chamber and coupled to the shell, the support frame includes:

a pair of first support members being substantially parallel to each other; and a pair of second support members each positioned orthogonal to the pair of first support members, the pair of second support members being substantially parallel to each other; and wherein the pair of first support members are vertically displaced from the pair of second support members.

10. The heat exchanger of claim 9, wherein: each of the plurality of first rods extends between the pair of first support members; and each of the plurality of second rods extends between the pair of second support members.

11. The heat exchanger of claim 10, wherein the impingement device covers an area that is at least 10% greater than an area of the inlet port.

12. The heat exchanger of claim 8, wherein each rod of the plurality of first and second rods is cylindrical.

13. The heat exchanger of claim 12, wherein each rod of the plurality of first and second rods includes a diameter that is less than or equal to a diameter of the one or more process tubes.

14. The heat exchanger of claim 8, wherein the first orientation is substantially orthogonal to the second orientation.

15. A method of assembling an impingement device according to claim 1, the method comprising the steps of: positioning a first set of members at a first orientation within a chamber of a heat exchanger; and positioning a second set of members at a second orientation that is angularly disposed relative to the first orientation.

16. The method of claim 15, further comprising positioning the first and second sets of members on a support frame coupled to the heat exchanger between an inlet and a plurality of process tubes.

17. The method of claim 15, wherein the first orientation is substantially orthogonal to the second orientation.

* * * * *